US005101696A

United States Patent [19]

Neff

[11] Patent Number: 5,101,696

[45] Date of Patent: Apr. 7, 1992

[54] DRIVING TOOL WITH DUAL-POSITION HANDLE AND LOCKING MEANS THEREFOR

[76] Inventor: Ted Neff, 24701 Raymond,, El Toro, Calif. 92630

[21] Appl. No.: 570,165

[22] Filed: Aug. 17, 1990

Related U.S. Application Data

[63] Continuation of Ser. No. 370,799, Jun. 23, 1989, abandoned.

[51] Int. Cl.[5] ..... B25B 15/00

[52] U.S. Cl. ..... 81/177.8; 81/440; 81/450

[58] Field of Search ..... 81/177.5–177.9, 81/440, 450, 489

[56] References Cited

U.S. PATENT DOCUMENTS

| | | | |
|---|---|---|---|
| 428,662 | 5/1890 | Bartlett | 81/177.6 X |
| 903,549 | 11/1908 | Dood | 81/440 |
| 1,036,379 | 8/1912 | Tibbals | 81/177.6 X |
| 1,215,308 | 2/1917 | Johnson | 81/440 X |
| 3,773,094 | 11/1973 | Kuenzel | 81/177.8 X |
| 4,590,824 | 5/1986 | Cushman | 81/440 |

*Primary Examiner*—James G. Smith

[57] ABSTRACT

This invention relates to a driving tool having a dual-position handle for turning screws, nuts, bolts and the like. In the first of the two operating positions, the handle is locked in longitudinal alignment with a drive shaft for fast operation substantially in the manner of a common, ordinary screwdriver or nutdriver for as long as the work piece is relatively easy to turn. When the turning operation becomes more difficult as the work piece is progressively tightened and a means for applying additional torque would be desirable and of considerable advantage, such as during the last tightening turns, the handle may be unlocked and pivoted from its first operating position to a second operating position whereby it intersects the longitudinal axis of the drive shaft by as much as a 90-degree angle, thereby providing a means whereby the amount of torque that can be applied is substantially increased. Such increased torque would also be extremely advantageous in breaking loose certain work pieces, such as screws or nuts that have become rusted in place and resist removal with an ordinary screwdriver or nutdriver.

9 Claims, 2 Drawing Sheets

DRIVING TOOL WITH DUAL-POSITION HANDLE AND LOCKING MEANS THEREFOR

This application is a continuation, of application Ser. No. 07/370,799, filed June 23, 1989 now abandoned.

FIELD OF THE INVENTION

This invention relates to hand tools in general, and more particularly to a driving tool having a dual-positioned handle for turning screws, nuts, bolts, and the like.

BACKGROUND OF THE INVENTION

In the hand tool field, the use of screwdrivers and nutdrivers is well known to the art. However, there is an inherent problem with both of these types of tools in that they are limited in the amount of torque, or turning power that can be applied with the handles being integral with their driving shafts and in axial alignment therewith. There are also T-handled driving tools that provide additional driving power, but they are much slower and more tedious to turn than the ordinary driving tools mentioned above. There have been attempts in the past to resolve the two problems mentioned, one of these being the patent to Bartlett, U.S. Pat. No. 428,662 of May 27, 1890. While solving the torque problem by providing a pivoting handle, the Bartlett device created new ones. The center portion of the handle was enlarged to accommodate the locking mechanism used and the lump would be quite uncomfortable in the hand during a turning operation. In addition, a pin projects outward from the middle portion of the handle which would be even more uncomfortable to the operator when gripping the handle. Applicant's tool, on the other hand, has all of the locking mechanisms contained within the handle with no lumps, pins, or other projections that would affect the operator's grip on the handle, and there are no pins, latches, or other such means necessary to lock and unlock the tool.

SUMMARY OF THE INVENTION

The present invention resides in a driving tool having a handle that is pivotable to two driving positions, the first position being wherein the handle and driving shaft are in axial alignment and the handle may be locked in that position. The second position being wherein the handle is perpendicular to the longitudinal axis of the shaft in a T-handle fashion and the handle may also be locked in that position. The driving shaft is pivotably attached to the handle and is disposed in a bore that extends longitudinally partly through the handle. An open channel runs partly up one side of the handle and opens into the bore, and the shaft is pivoted through this channel to either of the driving positions. Means are provided so that the shaft may be pushed a short distance into the handle in order to engage the locking devices in both driving positions.

Normally, the T-handle position would be used only in those cases where an extra tight fit is desired, or to loosen a fitting that is too tight to release in the axial alignment position of the handle and shaft. This occurs often when the fitting has become frozen or rusted in place and additional turning power is needed to free it.

Four preferred embodiments of this invention will be illustrated, described more fully hereinafter, and claimed in the appended claims.

It is, therefore a primary object of this invention to provide a driving tool for screws, nuts, bolts and the like that can be easily and quickly spun in the manner of ordinary driving tools with fixed handles, but which may be switched from a straight-handle to a T-handled driver to gain additional torque.

A second object of the invention is to provide a locking means whereby the handle and driving shaft may be locked firmly and securely in a first driving position wherein the handle is in axial alignment with the longitudinal axis of said driving shaft.

A third object of the invention is to provide a means whereby said handle may be unlocked from the first driving position and pivoted to a second driving position wherein the handle is perpendicular to the longitudinal axis of the shaft and locked in that position.

A fourth object of my invention is to provide such a tool as is described above that is simple in construction, has a minimum of parts, and will be economical to manufacture.

Other objects and advantages will appear in the combination of the elements, arrangement of the parts, and particular features of construction which will be pointed out more fully hereinafter and disclosed in the accompanying drawings, wherein the preferred embodiments of the invention are presented.

It will be understood that the connector means and accessory attachments illustrated in the drawings are shown as examples only and are not necessarily limited to those shown, but may be of any type found to be suitable and useful. Such means are well known to the art and therefore do not form a part of the inventive concept presented herein.

DETAILED DESCRIPTION OF THE INVENTION

Figure 1:
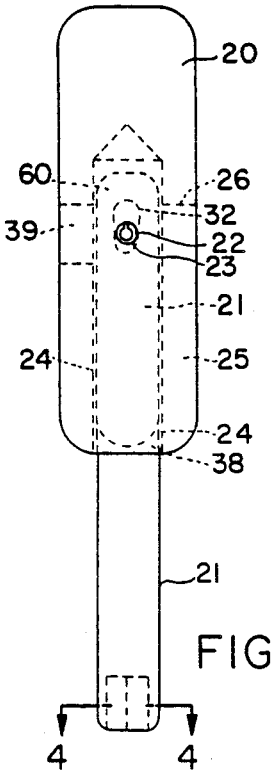
FIG. 1 is a plan view of the first preferred embodiment of the invention with the handle locked in the first driving position.
Figure 9:
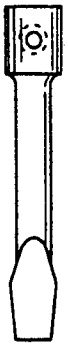
FIG. 9 is an elevation of just one of a variety of accessory attachments that may be used with all embodiments of the tool.
Figure 10:
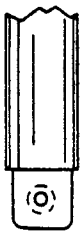
FIG. 10 is an elevation, partly broken away, of just one of several connector means that may be used with all preferred embodiments of the tool.

In describing my invention as illustrated in the drawings, refer to FIG. 1 where a handle 20 is attached to one end of a driving shaft 21 by a pivot pin 22 in a small bore 23 extending laterally through said handle 20. The other end of the shaft has a connector means for receiving accessory attachments such as the one shown in FIG. 9. Handle 20 has a first cylindrical bore 24 extending inwardly along its longitudinal axis for a distance of approximately two-thirds of its length. There is also an open channel 25 having parallel walls extending upward from the lower end of handle 20 for better than one-half of its length, the channel 25 opening into one side of bore 24. The inner end of channel 25 is enclosed by a wall 26. An extension 37 of bore 24 goes beyond wall 26. Disposed within bore 24 is the inner end 60 of shaft 21. The shaft 21 has a narrow portion composed of flat surfaces 27 and 28 on the upper portion thereof. Said flat surfaces permitting shaft 21 to pivot outward through channel 25 on pin 22. Cylindrical portion 38, although not shown in all of the Figures where sectional views are used, is present in all of the embodiments of this invention.

Figure 2:
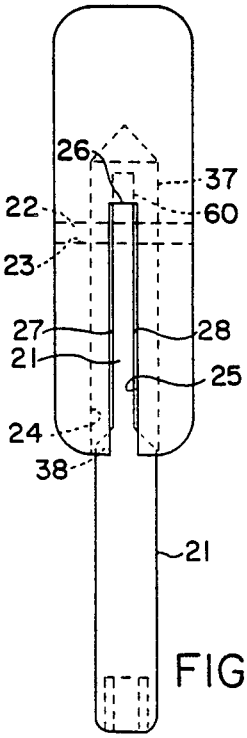
FIG. 2 is a plan view of the tool in FIG. 1 rotated 90 degrees clockwise.
Figure 3:
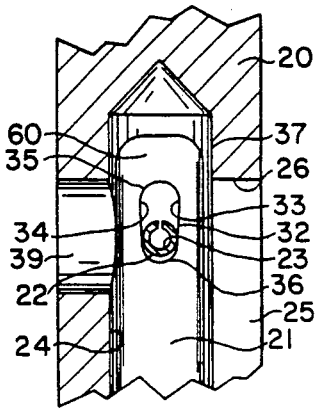
FIG. 3 is an enlarged portion of the tool in FIG. 1, partly in elevation and partly in section, showing the internal construction with the handle locked in the first driving position.
Figure 4:
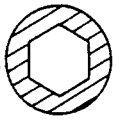
FIG. 4 is an enlarged cross section taken in the direction of the arrows on broken line 4—4 of FIG. 1.
Figure 5:
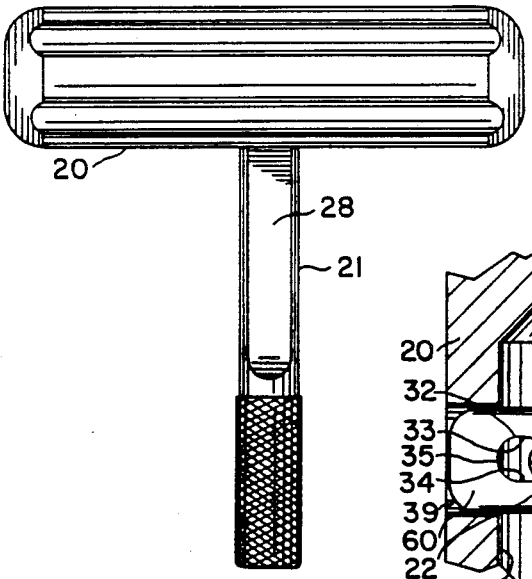
FIG. 5 is an elevation of the invention in the second driving position.
Figure 6:
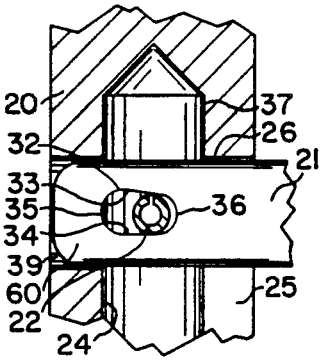
FIG. 6 is an enlarged portion of the tool comprising the invention in the first preferred embodiment, partly in elevation and partly in section, showing the tool locked in the second driving position.

In the first preferred embodiment of the invention shown in FIGS. 1, 2, 3, and 6, shaft 21 has an oblong slot 32 in its inner end 60, said slot being disposed along the longitudinal axis of the shaft 21. Slot 32 has tapered sidewalls 33 and 34 which converge toward each other from the slot's upper end 35 to its lower end 36. Pin 22 is disposed through said slot and has a diameter slightly smaller than the diameter of its upper end 35. When shaft 21 is pushed upward into bore extension 37, pin 22 will slide downward in slot 32 and converging walls 33 and 34 will close in on pin 22, causing a friction engagement between the walls 33 and 34 and pin 22. At the same time, the wider or cylindrical portion 38 on the lower part of the shaft will move upward into first bore 24 for a short distance, preventing shaft 21 from pivoting laterally through the channel 25, as is shown in FIGS. 1 and 2, and providing a second means for maintaining a rigid unity between handle 20 and shaft 21 in substantially axial alignment with each other in the first driving position. The flat surfaces 27 and 28 of the shaft 21 form a narrow portion of the shaft 21 which will pass through the channel 25 when the shaft 21 is pull outward from handle 20 a short distance to allow the handle 20 to pivot between its first and second positions. In order to be able to lock the handle and shaft in the second driving position, a short lateral second bore or opening 39 is disposed in the wall of the handle 20 capable of receiving the inner end 60 of driving shaft 21. Handle 20 is pivoted to a perpendicular or T-handle position and shaft 21 is pushed inward to where its inner end 60 enters second bore opening 39. This movement of the shaft causes sidewalls 33 and 34 to converge on pin 22 and lock the handle 20 and shaft 21 in the second driving position.

Figure 7:
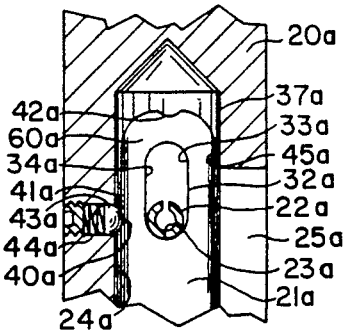
FIG. 7 is an enlarged portion of the tool, partly in elevation and partly in section, showing the locking means for the second preferred embodiment in the first driving position.
Figure 8:
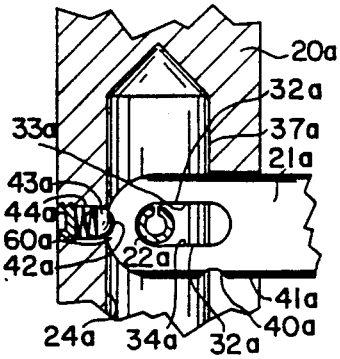
FIG. 8 is an enlarged portion of the tool, partly in elevation and partly in section, showing the locking means for the second preferred embodiment of the tool in the second driving position.

In the second preferred embodiment of the tool shown in FIGS. 7 and 8, driving shaft 21*a* has an oblong slot 32*a* containing sidewalls 33*a* and 34*a* in parallel alignment through which pin 22*a* is pivotably disposed. Shaft 21*a* has a small recess or groove 40*a* best seen in FIG. 8, on its inner side 41*a*. A second small recess or groove 42*a* is disposed on the extreme inner end of shaft 21*a*. A spring-biased ball detent 43*a* is disposed in an aperture 44*a* in the wall of the handle 20*a* and is positioned laterally opposite pin 22*a*. When shaft 21*a* is pushed into the handle, ball detent 43*a* comes into contact with recess or groove 40*a* and pushes the shaft 21*a* against pin 22*a* and also against wall 45*a* of bore extension 37*a*, locking the shaft between the pin 22*a* and wall 45*a* in axial alignment with the handle in the first driving position. To obtain the second driving position, the shaft 21*a* is pulled out from the handle 20*a*, releasing the ball detent 43*a* from the recess or groove 40*a*, and the handle 20*a* is pivoted to the T-handle position which automatically brings ball detent 43*a* into contact with recess or groove 42*a* in the end of the shaft and locks the handle and shaft in the second driving position. As in the first embodiment, cylindrical portion 38, although not shown, is present in the embodiment in FIGS. 7 and 8 of the drawings as stated previously herein.

Figure 11:
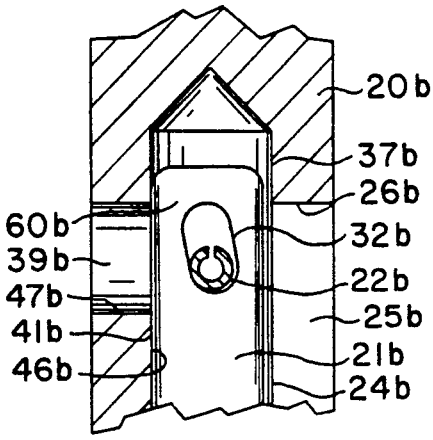
FIG. 11 shows an enlarged portion of the third embodiment of the tool, partly in elevation and partly in section, illustrating the locking means in the first driving position.
Figure 12:
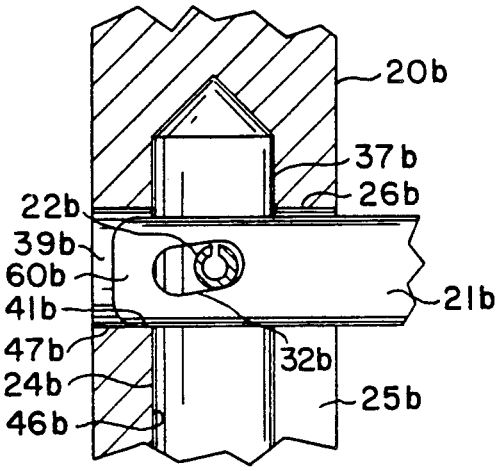
FIG. 12 is an enlarged portion of the third preferred embodiment of the tool, partly in elevation and partly in section, showing the locking means in the second driving position.

In the third preferred embodiment of the invention as shown in FIGS. 11 and 12, shaft 21*b* has an oblong slot 32*b* disposed in its inner end 60*b* with pin 22*b* pivotably inserted therein. Slot 32*b* is acutely angled so that when pin 22*b* is in its upper end, handle 20*b* and shaft 21*b* are in axial alignment with each other, but when the shaft is pushed upward into the handle, pin 22*b* will slide to the lower end of slot 32*b* and shift the driving shaft 21*b* out of its axially aligned position. This action will cause side 41*b* of the shaft to come in contact with wall 46*b* of first bore 24*b*, locking the handle and shaft in the first driving position. To obtain the second driving position, shaft 21*b* is pulled outward from handle 20*b* to unlock the handle 20*b* from the shaft 21*b*, and the handle 20*b* is pivoted to a perpendicular or T-handle position in relation to driving shaft 21*b*. Shaft 21*b* is then pushed into the handle to where it enters the lateral second bore 39*b* and its sidewall 41*b* contacts wall 47*b* of the bore 39*b* as a result of the angled slot 32*b* and locks the handle 20*b* and shaft 21*b* between pin 22*b* and the inner wall of bore 39*b*, locking said shaft and handle in the second driving position. Cylindrical portion 38, although not shown in the drawings for this embodiment, is present and performs the same function as it does in the first and second preferred embodiments.

Figure 13:
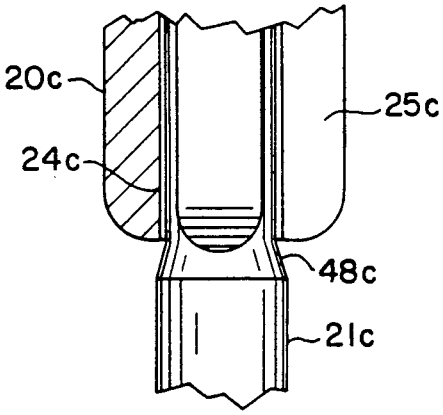
FIG. 13 is an enlarged portion of the fourth preferred embodiment of the invention, partly in elevation and partly in section, showing the locking means in the first driving position.
Figure 14:
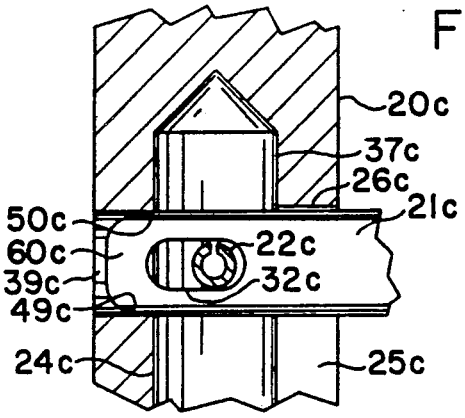
FIG. 14 is an enlarged portion of the fourth preferred embodiment of the tool, partly in elevation and partly in section, showing the locking means in the second driving position.

In the fourth preferred embodiment of the invention as shown in FIGS. 13 and 14, slot 32*c* is the same as that used in the second preferred embodiment of FIGS. 7 and 8. However, the locking means in this embodiment consists of a tapered section 48*c* on the lower cylindrical portion of shaft 21*c*. When shaft 21*c* is pushed upward into handle 20*c*, the tapered section 48*c* comes into contact with the lower end of bore 24*c* where it exits from handle 20*c*, locking said handle 20*c* and shaft 21*c* in the first driving position. To lock the handle 20*c* and shaft 21*c* in the second driving position, the inner end 60*c* of shaft 21*c* is tapered at 49*c* and 50*c*. When the shaft is pushed inward, its inner end 60*c* enters into lateral bore 39c whose diameter is smaller than the width of shaft 21c, causing tapered walls 49c and 50c to come into frictional contact with the wall of lateral bore or opening 39c, thereby locking the handle and shaft together in the second position.

What is claimed is:

1. A driving tool having a dual position handle comprising:

(a) a shaft having connector means for receiving a plurality of accessory attachments, said connector means formed upon the distal end of said shaft;

(b) a handle pivotally attached to said shaft, said handle having a first bore extending axially partially therethrough, said handle being disposable substantially in axial alignment with said shaft and also disposable substantially perpendicular to said shaft;

(c) a first means for locking said handle substantially in axial alignment with said first, said means for locking said handle substantially in axial alignment with said shaft being activated by pushing said shaft a short distance into said handle;

(d) means for locking said handle substantially perpendicular to said shaft, said means for locking said handle substantially perpendicular to said shaft being activated by pushing said shaft a short distance into said handle;

(e) a second means for locking said handle substantially in axial alignment with said shaft, said second means supplementing said first means to prevent said shaft from pivoting while locked in the substantially axially aligned position with said handle, said second means being activated simultaneously with said first means; and (f) wherein all of the locking means may be unlocked by pulling said shaft a short distance out of said handle.

2. A driving tool as recited in claim 1 wherein said first means for locking said handle substantially in axial alignment with said shaft comprises:

(a) a pin attached to said handle and slidably disposed within a tapered slot, said tapered slot being formed in the inner end of said shaft such that when said shaft is pushed into said handle, said pin frictionally engages the tapered sides of said tapered slot; and (b) wherein the means for locking said handle substantially perpendicular to said shaft comprises a second, short bore disposed in said handle laterally opposite said pin such that when said shaft is shifted to said substantially perpendicular position and pushed into said handle, said pin frictionally engages the tapered sides of said slot when the inner end of said shaft enters said second bore.

3. The device of in claim 2 wherein said second means for locking said handle substantially in axial alignment with said shaft comprises:

(a) a channel formed longitudinally within said handle for permitting said shaft to pivot between said substantially axial alignment position and said substantially perpendicular position;

(b) a narrow portion of said shaft formed along the upper portion of said shaft and sized to pass through said channel;

(c) a wider portion of said shaft too large to pass through said channel; and (d) wherein, when said shaft is pulled a short distance out of said handle, the wider portion of said shaft does not obstruct the pivoting of said handle from its first position in substantially axial alignment with said shaft and its second position substantially perpendicular to said shaft, and when said shaft is pushed into said handle a short distance to activate said first locking means, the wider portion of said shaft obstructs the pivoting of said handle from its first position to its second position.

4. The invention of claim 1 wherein said first means for locking said handle substantially in axial alignment with said shaft when said shaft is pushed into said handle comprises:

(a) an oblong slot formed in the inner end of said shaft, said slot being disposed at an acute angle to the longitudinal axis of said shaft;

(b) a pin disposed within said slot and attached to said handle such that when said shaft is pushed into said handle, said slot cooperates with said pin to move said shaft angularly upward and frictionally engage said shaft between said pin and inner wall of said first bore; and (c) wherein said means for locking said handle substantially perpendicular to said shaft comprises a second short bore disposed laterally opposite said pin such that when said shaft is pushed into said handle, said slot cooperates with said pin to shift said shaft angularly inward, causing said shaft to be frictionally engaged between said pin and the wall of said second bore.

5. The device as recited in claim 1 wherein said first means for locking said handle substantially in axial alignment with said shaft comprises:

(a) a pin attached to said handle and slidably disposed within an oblong slot in the inner end of said shaft;

(b) a spring-biased ball detent disposed in an aperture in a sidewall of said handle;

(c) a first recess formed in a sidewall of said shaft, said ball detent cooperating with said first recess to lock said handle and said shaft in substantially axial alignment when said shaft is pushed into said handle a short distance; and (d) wherein said means for locking said handle substantially perpendicular to said shaft comprises said spring-biased ball detent and a second recess on the proximal end of said shaft cooperating with said spring-biased ball detent such that when said shaft is pulled outward and then pivoted to the perpendicular position in relation to said handle, said ball detent will engage said second recess in the proximal end of said shaft and lock said handle and said shaft in said substantially perpendicular position.

6. The invention of claim 1 wherein said first means for locking said handle substantially in axial alignment with said shaft comprises:

(a) a pin attached to said handle and slidably disposed within an oblong slot in the inner end of said shaft;

(b) a tapered portion of said shaft immediately adjacent the lower end of said first bore, said tapered portion cooperating with said first bore such that when said shaft is pushed into said second bore, said tapered portion will frictionally engage the inner wall of said second bore; and (c) wherein said means for locking said handle substantially perpendicular to said shaft is comprised of a second tapered portion on the inner end of said shaft and a second bore in said handle disposed laterally opposite said pin, said second bore being sized to frictionally receive said tapered end of said shaft when said shaft is pivoted to a perpendicular position in relation to said handle and pushed into said second bore.

7. The device recited in claim 4 wherein said second means for locking said handle in substantially axial alignment with said shaft comprises:

(a) a channel formed longitudinally within said handle for permitting said shaft to pivot between said substantially axial alignment position and said substantially perpendicular position;

(b) a narrow portion on said shaft formed along its upper portion and sized to pass through said channel;

(c) a wider portion of said shaft sized too large to pass through said channel; and (d) wherein, when said shaft is pulled a short distance out of said handle, the wider portion of said shaft does not obstruct the pivoting of said handle from its first position in substantially axial alignment with said shaft and its second position substantially perpendicular to said shaft, and when said shaft is pushed into said handle a short distance to activate said first locking means, the wider portion of said shaft obstructs the pivoting of said handle from its first position to its second position.

8. The hand tool as recited in claim 5 wherein said second means for locking said handle in substantially axial alignment with said shaft comprises:

(a) a channel formed longitudinally within said handle opening into said first bore for permitting said shaft to pivot between said substantially axial alignment position and said substantially perpendicular position;

(b) a narrow portion of said shaft formed along the upper portion of said shaft and sized to pass through said channel;

(c) a wider portion of said shaft sized too large to pass through said channel; and (d) wherein, when said shaft is pulled a short distance out of said handle, the wider portion of said shaft does not obstruct the pivoting of said handle from its first position in substantially axial alignment with said shaft and its second position substantially perpendicular to said shaft, and when said shaft is pushed into said handle a short distance to activate said first locking means, the wider portion of said shaft obstructs the pivoting of said handle from its first position to its second position.

9. The device as recited in claim 6 wherein said second means for locking said handle in substantially axial alignment with said shaft comprises:

(a) a channel formed longitudinally within said handle and opening into said first bore for permitting said shaft to pivot between said substantially axial alignment position and said substantially perpendicular position;

(b) a narrow portion of said shaft formed along the upper portion of said shaft and sized to pass through said channel;

(c) a wider portion of said shaft sized too large to pass through said channel; and (d) wherein, when said shaft is pulled a short distance out of said handle, the wider portion of said shaft does not obstruct the pivoting of said handle from its first position in substantially axial alignment with said first and its second position substantially perpendicular to said shaft, and when said shaft is pushed into said handle a short distance to activate said first locking means, the wider portion of said shaft obstructs the pivoting of said handle from its first position to its second position.

* * * * *